US009127838B2

(12) United States Patent
Paesani et al.

(10) Patent No.: US 9,127,838 B2
(45) Date of Patent: Sep. 8, 2015

(54) GAS BURNER FOR COOKING APPLIANCES

(75) Inventors: Carlo Paesani, Camerano (IT); Girolamo Tommaso Emiliani, Fermo (IT)

(73) Assignee: DEFENDI ITALY S.R.L., Camerano (IT)

( * ) Notice: Subject to any disclaimer, the term of this patent is extended or adjusted under 35 U.S.C. 154(b) by 1306 days.

(21) Appl. No.: 12/449,797

(22) PCT Filed: Mar. 17, 2008

(86) PCT No.: PCT/EP2008/053154

§ 371 (c)(1), (2), (4) Date: Aug. 27, 2009

(87) PCT Pub. No.: WO2008/116773

PCT Pub. Date: Oct. 2, 2008

(65) Prior Publication Data

US 2010/0092902 A1 Apr. 15, 2010

(30) Foreign Application Priority Data

Mar. 23, 2007 (IT) ..... VE2007A0018

(51) Int. Cl.
*F23D 14/00* (2006.01)
*F23D 14/64* (2006.01)
(Continued)

(52) U.S. Cl.
CPC .... *F23D 14/065* (2013.01); *F23D 2900/14062* (2013.01); *F23D 2900/14063* (2013.01)

(58) Field of Classification Search
CPC ..... F23D 14/06; F23D 14/64; F23D 14/62; F23D 14/46; F23D 2900/14062; F23D 2900/14063
USPC ..... 431/198, 200, 264, 278, 281, 284, 285, 431/354; 126/39 R, 39 AB, 39 N, 39 E, 39 K
See application file for complete search history.

(56) References Cited

U.S. PATENT DOCUMENTS 5,277,576 A * 1/1994 Hartung et al. ..... 431/198
5,401,164 A 3/1995 Yen
(Continued)

FOREIGN PATENT DOCUMENTS

EP 0 903 538 3/1999
EP 1 042 634 10/2000
(Continued)

*Primary Examiner* — Steven B McAllister
*Assistant Examiner* — Desmond C Peyton
(74) *Attorney, Agent, or Firm* — Themis Law

(57) ABSTRACT

An improved gas burner for cooking appliances, with an inner central portion (40) defining an inner chamber (52) provided with a central flame ring (72) and with an outer portion (42) concentric with said central portion (40) defining an outer chamber (47) provided with at least one outer flame ring (78), characterised by comprising a pair of first injectors (14) of substantially horizontal axis, symmetrically disposed about a diametrical vertical plane of said burner, said first injectors (14) being associated with respective adjacent venturi conduits (24) with substantially horizontal parallel axes, feeding said outer portion (42) with a gas/primary air mixture to generate said outer flame ring (78), said adjacent conduits (24) being spaced apart to define a space within which a second injector (16) of vertical axis is disposed facing a venturi conduit (50) of vertical axis feeding said inner central portion (40) with a gas/primary air mixture to generate said central flame ring (72).

15 Claims, 4 Drawing Sheets

(51) Int. Cl.

| | |
|---|---|
| ***F24C 3/08*** | (2006.01) |
| ***F23D 14/06*** | (2006.01) |
| *F23Q 3/00* | (2006.01) |

(56) References Cited

U.S. PATENT DOCUMENTS

| | | | | |
|---|---|---|---|---|
| 5,704,778 | A * | 1/1998 | Hsieh | 431/354 |
| 6,132,205 | A * | 10/2000 | Harneit | 431/354 |
| 6,325,619 | B2 * | 12/2001 | Dane | 431/284 |
| 6,332,460 | B1 * | 12/2001 | Paesani | 126/39 R |
| 7,594,812 | B2 * | 9/2009 | Armanni | 431/283 |
| 7,661,954 | B2 * | 2/2010 | Harneit | 431/278 |
| 7,878,800 | B2 * | 2/2011 | Bettinzoli | 431/354 |
| 7,901,205 | B2 * | 3/2011 | Trochou | 431/284 |
| 8,206,148 | B2 * | 6/2012 | Paesani | 431/284 |
| 8,221,116 | B2 * | 7/2012 | Biagioli et al. | 431/284 |
| 8,753,112 | B2 * | 6/2014 | Armanni et al. | 431/354 |
| 2001/0010897 | A1 * | 8/2001 | Dane | 431/266 |
| 2006/0121402 | A1 * | 6/2006 | Bettinzoli | 431/354 |
| 2007/0218414 | A1 * | 9/2007 | Harneit | 431/354 |
| 2008/0206697 | A1 * | 8/2008 | Trochou | 431/284 |
| 2009/0047611 | A1 * | 2/2009 | Armanni | 431/284 |
| 2010/0319677 | A1 * | 12/2010 | Lacche | 126/39 E |

FOREIGN PATENT DOCUMENTS

| | | |
|---|---|---|
| EP | 1 120 603 | 8/2001 |
| WO | WO 2006/005428 | 1/2006 |
| WO | WO 2006/077086 | 7/2006 |
| WO | WO 2007/012766 | 2/2007 |

* cited by examiner

GAS BURNER FOR COOKING APPLIANCES

The present invention relates to an improved gas burner for cooking appliances.

BACKGROUND OF THE INVENTION

Standard gas burners are known comprising a single flame ring of various dimensions and developable powers.

Special gas burners are also known comprising several concentric flame rings. They are commonly known as wok burners, from the name of the convex-based pans which are widespread in Asiatic countries, and require burners with several concentric rings.

Dual wok burners are also known, provided with special two-way valves for separately feeding the central flame ring and the annular ring or rings with gas, to hence generate either only the inner central flame ring or the central ring and the outer annular ring or rings, in order to vary the cooking intensity within wide limits, from just the inner flame ring fed at minimum level to all the flame rings fed at maximum level for high temperature cooking.

In order for a wok burner to completely cover market needs, it must simultaneously satisfy a large number of requirements, often of a contrasting nature. In particular:

- it must be of small vertical height, to be positioned either on cookers or on built-in hobs,
- it must be insensitive to the streaming effect, i.e. it must be able to remain always ignited, even under minimum flow conditions, in the case of a reduction in pressure accidentally caused by the effect of opening a door in the kitchen cabinet below the hob,
- it must be able to develop high power,
- its injectors must be accessible from above for easy replacement if the burner has to be adapted to gas types different from that for which the burner was factory set,
- it must be able to operate both as a dual burner, i.e. fed via a two-exit valve, and as a three ring burner, i.e. fed via a normal single-exit valve.
- it must comprise just a fed easily assembled parts of low cost,
- all its parts must be easily accessible for simple cleaning.

Various burner types have been proposed to satisfy most of the aforelisted requirements, however they all represent compromise solutions aimed at enhancing certain requirements at the necessary sacrifice of others.

IT 1,232,887 describes a dual burner provided with three injectors associated with three venturis of radial type, i.e. comprising a first vertical frusto-conical section followed by a radial horizontal section. This is of small vertical size, is able to provide reasonable power and uses primary air and secondary air withdrawn from above the hob, hence being substantially insensitive to the streaming effect.

The drawback of this known burner is that the two radial venturis which feed mixture to the outer portion of the burner determine its shape: in this respect, to obtain a radial portion the two venturis are made to extend towards the burner interior, so giving the outer burner portion a shape which is not annular, as is normally required for a wok burner, but presenting a circular outer perimeter and an elliptical inner perimeter. This gives the burner a strange shape and also subtracts secondary air from the central inner part of the burner; consequently the flames at the second ring and at the central burner are very small, hence hardly satisfying the concept of a wok burner, which instead requires considerable flame at the pan centre.

Moreover the three venturis are of small radial extension, with consequent limitation on the maximum power which the burner is able to develop.

U.S. Pat No. 5,401,164 describes a burner of type substantially similar to the preceding and with its venturi too short to develop sufficient power. Moreover this burner withdraws primary air exclusively from below the hob and is hence sensitive to the streaming effect.

U.S. Pat. No. 5,842,849 describes a burner with a cup support closed at its base, on which the injectors associated with the vertical venturis are positioned. The burner withdraws primary air from above the hob, however as the burner is of reduced height in order to be able to be housed within the hobs, its venturis are too short and hence of low efficiency.

EP 1 120 603 describes a burner with a vertical venturi feeding an inner central burner and a diametrical venturi feeding an outer annular burner.

The power developed by this burner is fairly limited; moreover the burner is formed from a very large number of parts and finally, as the two gas inlets feeding the two separate nozzles cannot be connected together, the burner operates only as a dual burner and is unable to function as a single-command burner.

U.S. Pat No. 5,704,778 describes a burner with three horizontal venturis, which is able to develop moderate power, but withdraws the primary air from below the hob and is hence sensitive to the streaming effect.

EP 1 042 634 describes a burner with two injectors feeding a vertical venturi for an inner central flame ring and a horizontal venturi for an outer annular flame ring. The primary air for the vertical venturi is withdrawn from above the hob, whereas the primary air for the horizontal venturi is withdrawn from below the hob.

As the injector holder for the vertical venturi is positioned above the horizontal venturi, the axial length of the vertical venturi is too small and does not enable the burner to develop the required power.

BRIEF SUMMARY OF THE INVENTION

An object of the invention is to overcome all the limitations which are recognizable conjointly or separately in burners pertaining to the state of the art, by providing a burner which satisfies all the aforelisted requirements.

BRIEF DESCRIPTION OF THE DRAWINGS

This and other objects which will be apparent from the ensuing description are attained, according to the invention, by an improved gas burner for cooking appliances, as described in claim 1.

A preferred embodiment of the present invention together with some variants thereof are described in detail hereinafter with reference to the accompanying drawings, in which.

DETAILED DESCRIPTION

Figure 1:
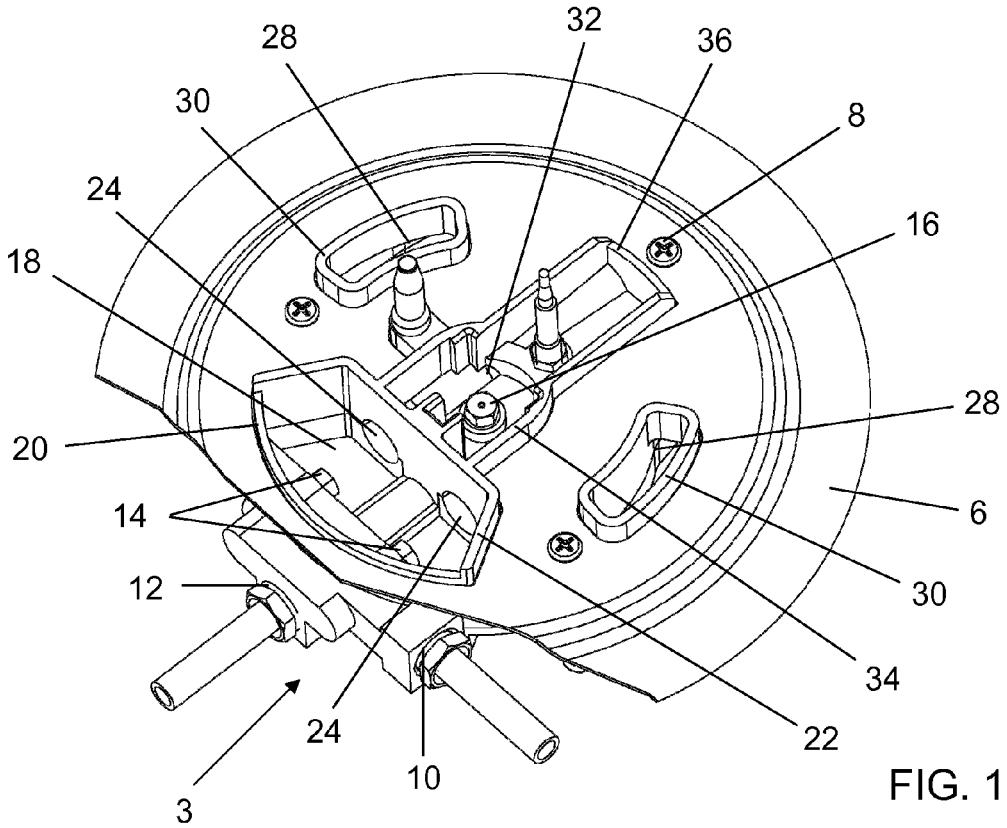
FIG. 1 is a partly interrupted perspective view of the cup-shaped support of the burner of the invention in its dual version.

FIGS. 1 to 5 show the burner of the invention in the dual version, comprising a cup-shaped support 3 formed from two superposed parts 2 and 4, which are coupled together and fixed to the upper sheet metal 6 of the hob by screws 8.

Two gas inlets 10 and 12 are provided at a vertical wall of the upper part 4 of the cup-shaped support 3.

The inlet 10 communicates with a pair of spaced-apart nozzles 14 of horizontal axis, whereas the inlet 12 communicates with a nozzle of vertical axis positioned at the centre of the cup-shaped support 3.

The two horizontal nozzles 14 terminate at an upperly open cavity 18 defined by a rim emerging from the sheet metal 6 of the cooking hob.

Specifically this rim, which forms all the side walls of the cavity 18, comprises a lesser projecting portion 20 of the cavity wall, to which the nozzles 14 are applied, and a greater projecting portion 22 involving the other three walls.

Two parallel venturi conduits 24 of horizontal axis extend from that wall of the cavity 18 opposite the wall to which the nozzles 14 are applied. These venturis extend from the cavity 18, they are spaced apart and, after passing through virtually the entire cup-shaped support 3, open into an arcuate channel 26 which extends as two branches, themselves extending upperly into two vertical channels 28 which pass through the sheet metal 6 of the hob and are each provided with a rim 30 projecting upwards to an extent equal to the rim 22 of the cavity 18.

The two horizontal venturis 24 extend spaced apart to define a space within which the nozzle 16 of vertical axis is positioned. It is housed in a cavity 32 defined by side walls which emerge via their upper rim from the sheet metal 6 of the hob.

This upper rim comprises a portion 34 joined to the greater projecting rim 22 of the cavity 18 and having the same height thereas, and a portion 36 more distant from the cavity 18 and depressed to an extent substantially equal to the rim 20 thereof.

The burner body 38 is positioned on the top portion 4 of the cup-shaped support 3. It comprises an inner cylindrical portion 40 and an outer annular portion 42 joined together by a substantially horizontal flange 44.

The outer annular portion 42 is provided with a base 46 in which two apertures are provided in positions corresponding with the vertical channels 28 of the cup-shaped support 3, so that when the burner body 38 is positioned on said cup-shaped support, there is communication continuity between the channel 26 and the annular cavity 47 of the portion 42.

The outer wall of the annular cavity 47 of the portion 42 is provided with a plurality of ports 48 for emergence of the gas-primary air mixture.

A vertical venturi conduit 50 is provided in the inner cylindrical portion 40 of the burner 38 and upperly faces the nozzle 16 of vertical axis. It opens upperly into a circular chamber 52, the outer wall of which comprises a plurality of ports 54.

The annular chamber 47 is closed upperly by a removable annular cover 56, while the circular chamber 52 is closed upperly by a circular cover 58.

The burner 38 rests on the cup-shaped support 3 at the greater projecting rims 22, 30 and 34 thereof, and remains centered in the correct mutual position by the engagement of its appendices 38, projecting downwards from the central portion 40 of the burner 38 and cooperating with the cavity 32 of the cup-shaped support 3. At the peripheral edge of its annular portion 42 it remains spaced from the sheet metal of the cooking hob, to hence define a passage for entry of the primary air which has to reach the two cavities 18 and 32.

Because of the lesser height of the rim 20 of the cavity 18 and of the rim 36 of the cavity 32, when the burner 38 is positioned on the cup-shaped support 3, two passages form between them to serve, as described hereinafter, to allow entry of primary air into the cavities 18 and 32 respectively, from above the hob.

in a position facing the depressed rim 36 of the cavity 32, the annular portion 42 of the burner 38 presents a channel 62, the side walls 64 of which present small slits 66.

The aforedescribed burner operates in the following manner.

Gas leaving through the vertical nozzle 16 and through the two spaced-apart horizontal nozzles 14 can be regulated in the required manner by a two-exit dual valve.

The gas flow leaving the vertical nozzle 16 entrains into the cavity 32 a flow of primary air originating from the top of the hob 6 via a first passage defined lowerly by this latter and upperly by the outer edge of the burner 38, and then via a second passage defined lowerly by the depressed rim 36 of the cavity 32 and upperly by the burner 38.

Figure 5:
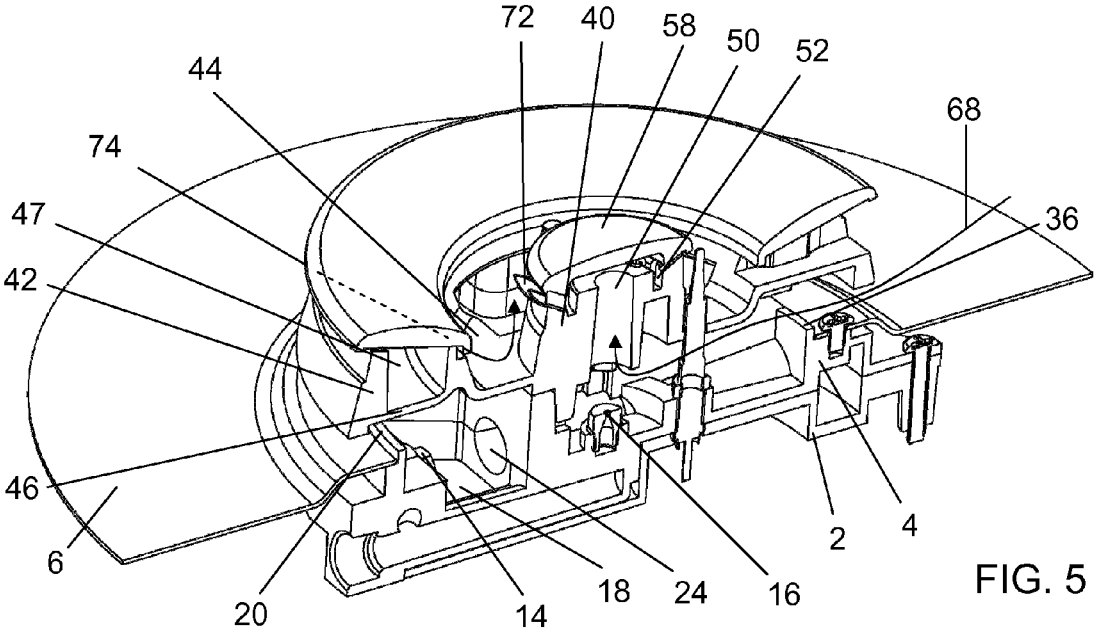
FIG. 5 is a perspective view of the burner shown sectioned on a diametrical vertical plane.

The path of the primary air is indicated by the arrow 68 in FIG. 5.

Within the vertical venturi 50 the gas mixes with the primary air, the formed mixture then reaching the circular cavity 52, from which it can leave towards the ports 54.

A suitable spark plug 70 positioned in proximity to the inner burner 40 ignites the flame ring 72, which remains fed with secondary air originating from above the sheet metal 6 of the hob, via the annular passage defined by this latter and by the burner 38.

The secondary air flow path for the central burner 40 is indicated by the arrow 74 in FIG. 5.

The gas flow leaving the two nozzles 14 entrains into the cavity 18 another flow of primary air originating from the top of the hob 6 via a first passage defined lowerly by this latter and upperly by the outer edge of the burner 38, and then via a second passage defined lowerly by the depressed rim 20 of the cavity 18 and upperly by the burner 38.

Figure 2:
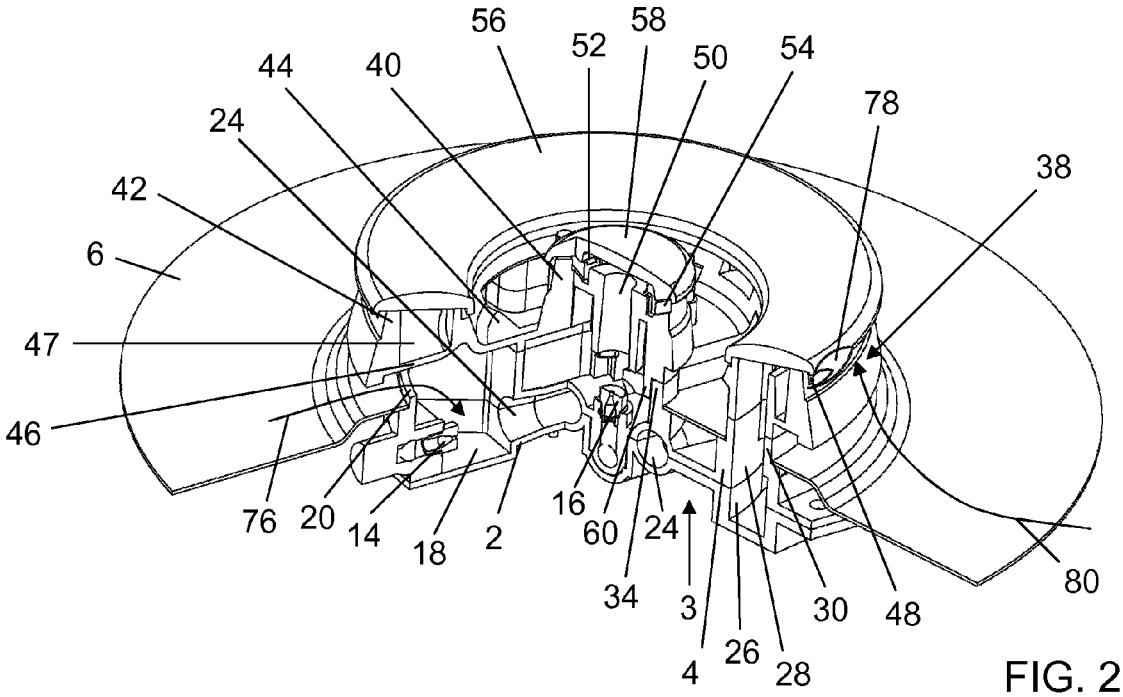
FIG. 2 is a perspective view of a burner of the invention in its dual version, shown partly sectioned on two vertical planes forming an angle therebetween.
Figure 3:
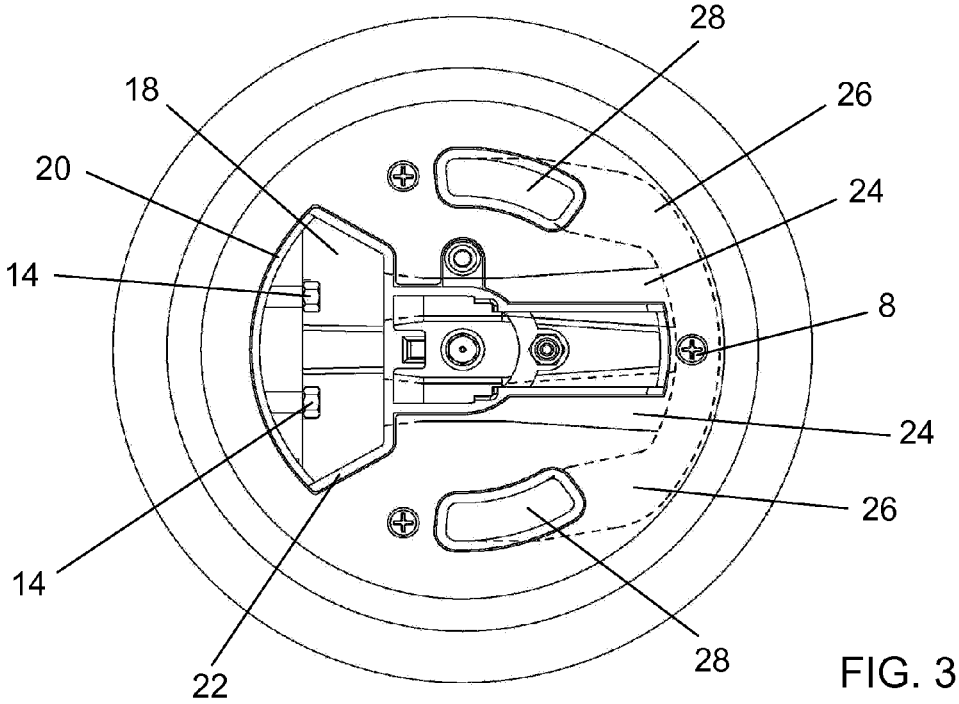
FIG. 3 is a plan view of the cup-shaped support.
Figure 4:
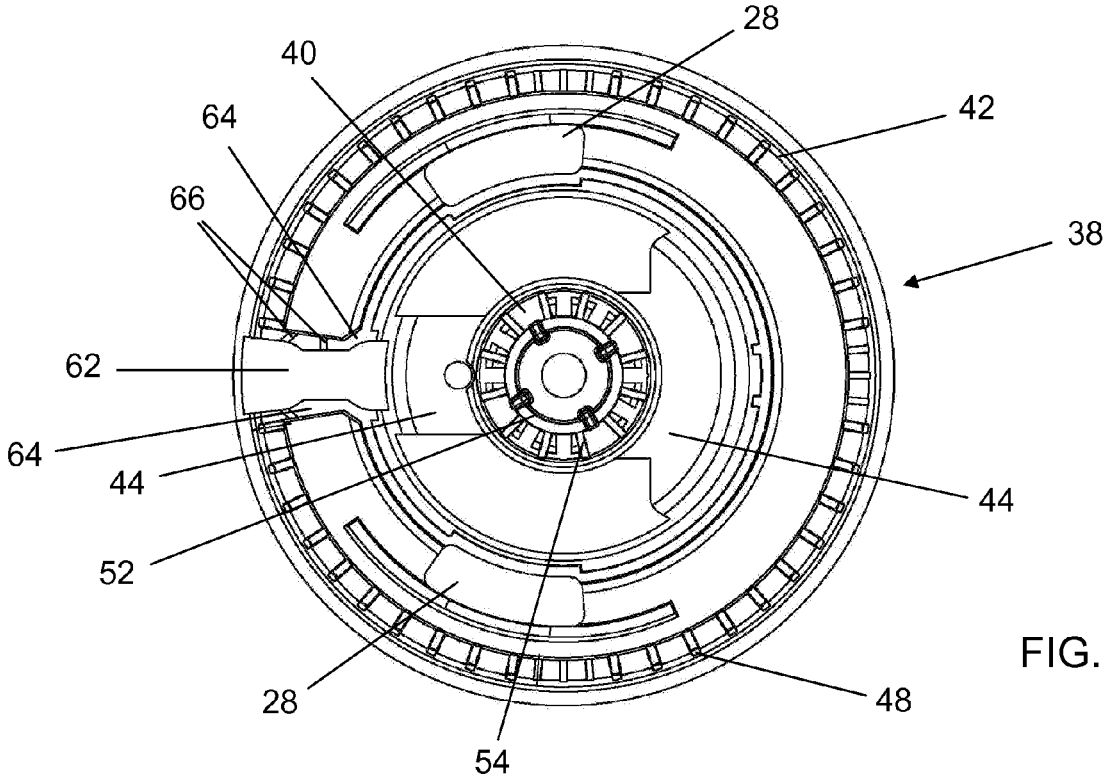
FIG. 4 is a plan view of the flame divider.

This flow of primary air is indicated by the arrow 76 in FIG. 2.

Within the two horizontal venturis 24 the gas mixes with the primary air, the formed mixture passing through the two branches of the arcuate channel 26 and the two vertical channels 28 to reach the annular cavity 42, from which it can leave towards the ports 48, to give rise to the outer flame ring 78, fed by secondary air originating from above the hob 6, as indicate by the arrow 80 in FIG. 2.

If the dual valve is arranged to feed only the central nozzle 16 with gas, only the inner flame ring 72 will be fed. If the valve is then made to also feed the horizontal nozzles 14, the slits 66 give rise to flames which enable mixture ignition to be transmitted by the flames 72 to the flames 78.

Figure 6:
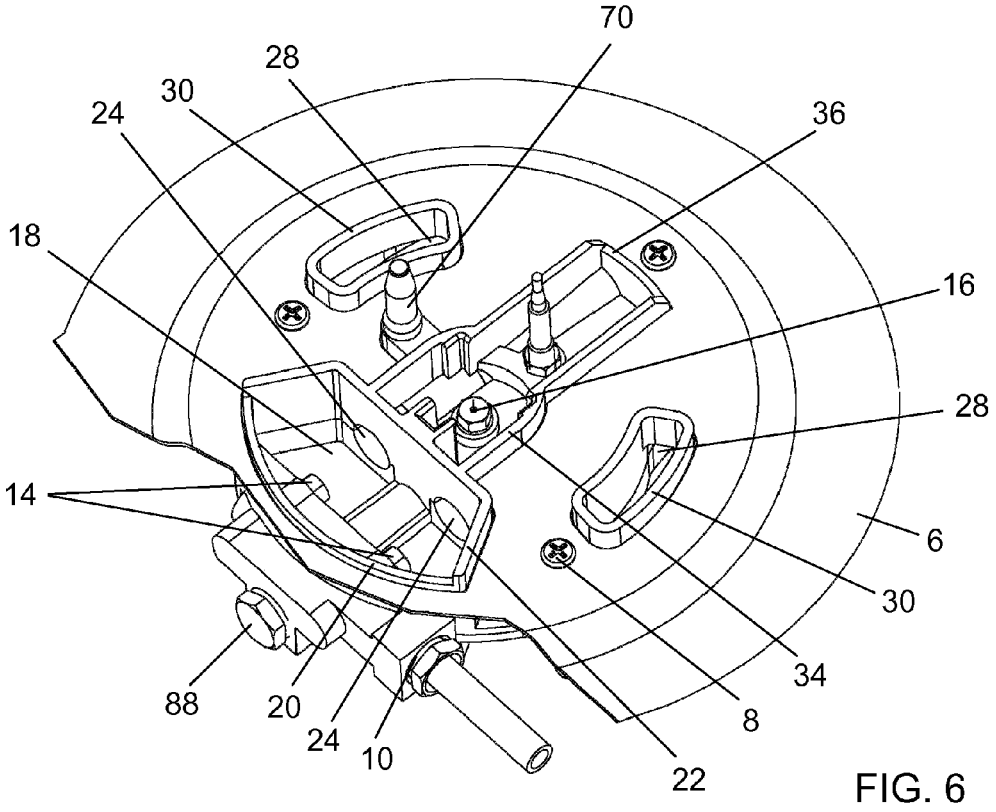
FIG. 6 shows the cup-shaped support in the same view as FIG. 1 but in the three ring version with a single gas inlet.

In the embodiment shown in FIG. 6 one of the two gas inlets is closed by a plug 88, while the other, fed by a single-exit valve, feeds both the two horizontal nozzles 14 and the vertical nozzle 16.

In this case the burner operates with the flame rings fed simultaneously, as in the case of traditional burners.

Figure 7:
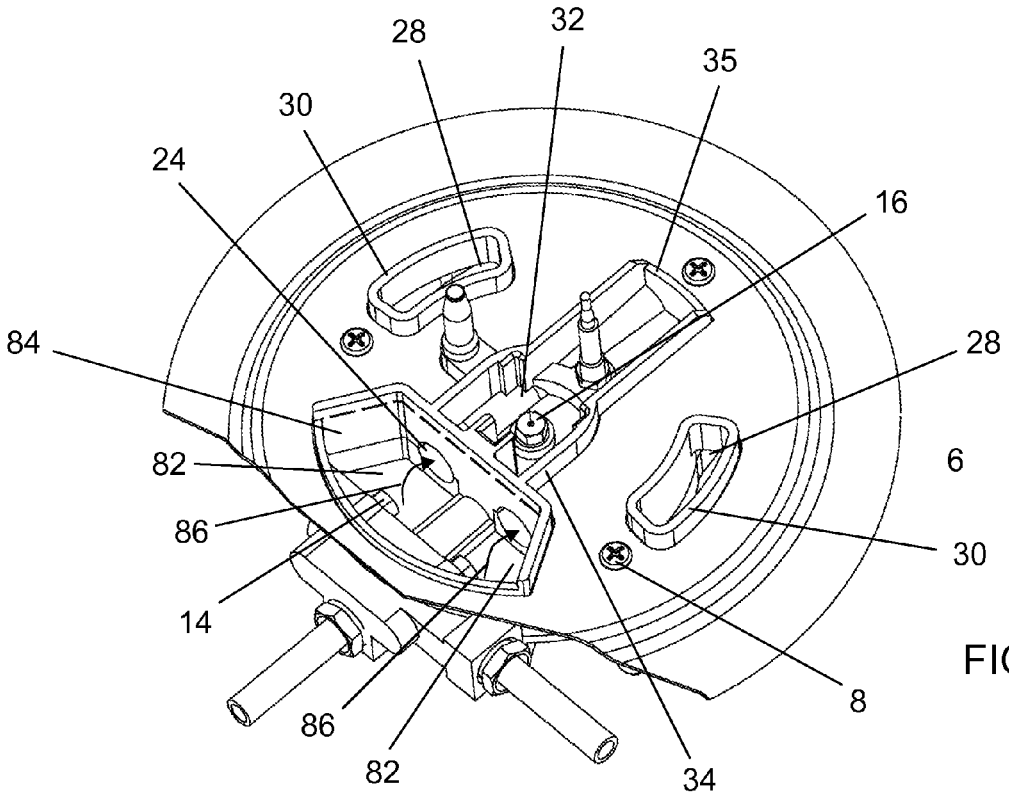
FIG. 7 shows a variant of the burner in the same view as FIG. 1, but with the primary air intake for the two injectors of horizontal axis positioned below the hob.

In the embodiment shown in FIG. 7, the chamber 18 comprises apertures 82 in its base and is closed upperly by a cover 84 fixed by screws.

In this manner the primary air flow entrained by the nozzles 14 is withdrawn from below the hob via the apertures 82, as indicated by the arrow 86.

This solution is more advantageous than the preceding one because of the presence of the cover 84, which prevents spilled liquids from entering the chamber 18, while at the same time enabling said cover 84 to be easily removed if the nozzles 14 need to be replaced.

This solution is also more advantageous than the preceding one with regard to the primary air volume which can be drawn in, and hence the greater power which the burner can develop. At the same time it is insensitive to the streaming effect in that, even if on opening and/or closing the ports below the hob the outer portion is extinguished, the inner portion, being fed by primary air originating from above the hob, continues to operate and is able to immediately re-ignite said outer portion.

In contrast, if this embodiment were applied to a cooker provided with a tangential fan for cooling the cavity, the burner could be disturbed and would require the installed fan to be suitably repositioned in order not to disturb the primary air flow.

Figure 8:
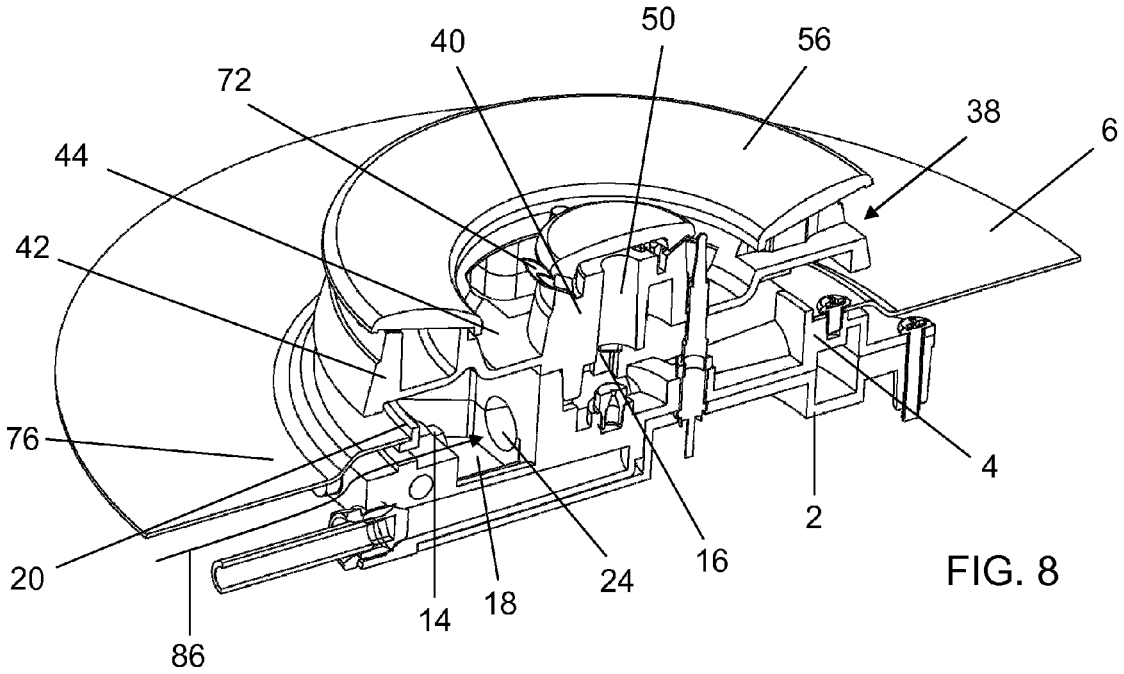
FIG. 8 shows a variant of the burner in the same view as FIG. 6, but with the primary air intake for the two injectors of horizontal axis positioned partly below and partly above the hob.

In the embodiment shown in FIG. 8 that wall of the chamber 18 to which the nozzles 14 are applied is provided with an aperture positioned below the sheet metal 6 of the hob.

In this case there are two primary air flows, which are entrained by the gas leaving the nozzles 14; one of these, the path of which is indicated by the arrow 76, is drawn from above the hob, while the other, the path of which is indicated by the arrow 86, is drawn from below the hob.

What is claimed is:

1. An improved gas burner for cooking appliances comprising:

a cup-shaped support coupled to an upper surface of a piece of sheet metal defining a cooking hob;

a couple of adjacent venturi conduits said adjacent venturi conduits having venturis defined therein, said adjacent venture conduits defined in said cup-shaped support and having substantially horizontal parallel axes, integrally obtained in said cup-shaped support and disposed symmetrically in response to a diametrical vertical plane of said burner;

first injectors associated in fixed relation to said adjacent venturi conduits and having axes that are substantially horizontal; and a burner body placed on said cup-shaped support and having an inner central portion, defining an inner chamber provided with a central flame ring and an outer portion concentric to said central portion, defining an outer chamber provided with at least one outer flame ring, said adjacent horizontal venturi conduits feeding said outer portion with a mixture of gas and primary air for generating said outer flame ring, wherein:

said first injectors are fixed to a vertical wall of a first cavity, obtained in said cup-shaped support and from which said adjacent horizontal venturi conduits extend beyond a central portion of said cup-shaped support, said first cavity being fluidly connected to a space outside of the gas burner above said cooking hob, said first cavity being further closed at a bottom, having an open top and being accessible from above, one or more arcuate channels being defined in a peripheral portion of said cup-shaped support and disposed at a lower level than said outer chamber, said venturi conduits being disposed to receive a gas and air mixture from said first cavity and discharge said gas and air mixture to said one or more arcuate channels, one or more apertures fluidly connecting said one or more arcuate channels with said outer chamber;

said adjacent horizontal venturi conduits are spaced apart, and define in said cup-shaped support a space therebetween, in which a second cavity is obtained, having a second injector with vertical axis fixed on a base of said second cavity, facing a venturi conduit also of vertical axis, obtained in said burner body and feeding said inner central portion with a mixture of gas and primary air for generating said central flame ring; and said second cavity is open upwardly and is connected to a space outside the burner above said cooking hob.

2. The burner according to claim 1 wherein said first cavity, in which said first injectors are applied, communicates exclusively with the space outside the burner above said cooking hob.

3. The burner according to claim 1 wherein said first cavity, in which said first injectors are applied, communicates both with the space outside the burner above the cooking hob and with the space outside the burner below the cooking hob.

4. The burner according to claim 1 wherein said central portion and said outer portion are separated by an annular interspace communicating with the outside of the burner body via an annular passage defined lowerly by the sheet metal of the cooking hob and upperly by the outer portion of the burner body.

5. The burner according to claim 1 wherein said one or more arcuate channels extends as two branches, which at their ends extend into vertical channels, communicating with said outer chamber via two apertures provided in a base of said outer chamber.

6. The burner according to claim 1 wherein the base of said second cavity is positioned at a lower level in respect to said adjacent venturi conduits.

7. The burner according to claim 5 wherein said burner body rests on said cup-shaped support on rims of said first and second cavities and of said upper apertures of said vertical channels.

8. The burner according to claim 7 wherein said central inner portion is provided lowerly with appendices facing downwards and cooperating with said second cavity to maintain said burner body centered on said cup-shaped support.

9. The burner according to claim 7 wherein said first cavity is closed lowerly and at least a part of its rim is depressed below a remaining part of the rim, to define with the overlying burner body a passage for the primary air intended for said first injectors.

10. The burner according to claim 7 wherein said second cavity is closed lowerly and at least a part of its rim is depressed below the remaining part of the rim itself to define with the overlying burner body a passage for the primary air intended for said second injector.

11. The burner according to claim 3 wherein said first cavity presents on its base at least an aperture for the passage of primary air coming from below the cooking hob and intended for said first injectors and it also presents at least a part of its rim depressed below the remaining part of the rim, to define with the overlying burner body a passage for further primary air coming from above the cooking hob and also intended for said first injectors.

12. The burner according to claim 10 wherein said outer portion of the burner presents in a portion facing the depressed rim of the second cavity a channel the side walls of which present small slits.

13. The burner according to claim 1 wherein said first cavity is closed upperly with a removable cover and is provided on its base with at least one aperture for the passage of primary air for said first injectors, coming from below the cooking hob.

14. The burner according to claim 1 wherein said first injectors and said second injector are connected to two separate gas inlets, fed by a dual valve with two exits.

15. The burner according to claim 1 wherein said first injectors and said second injector are connected to a single gas inlet, which is fed by a single-exit valve.

* * * * *